United States Patent [19]

Florens

[11] 4,073,652

[45] Feb. 14, 1978

[54] DIRECT-POSITIVE SILVER HALIDE EMULSIONS

[75] Inventor: Raymond Leopold Florens, Edegem, Belgium

[73] Assignee: AFGA-Gevaert N.V., Mortsel, Belgium

[21] Appl. No.: 607,909

[22] Filed: Aug. 26, 1975

[30] Foreign Application Priority Data

Sept. 30, 1974 United Kingdom ..... 42459/74

[51] Int. Cl.[2] ..... G03C 1/30; G03C 1/28

[52] U.S. Cl. ..... 96/101; 96/108; 96/110; 96/120

[58] Field of Search ..... 96/110, 101, 109, 120, 96/108

[56] References Cited

U.S. PATENT DOCUMENTS

| | | | |
|---|---|---|---|
| 3,615,610 | 10/1971 | Florens, et al. | 96/101 |
| 3,672,903 | 6/1972 | Chang | 96/110 |
| 3,736,140 | 5/1973 | Collier, et al. | 96/101 |

FOREIGN PATENT DOCUMENTS

| | | | |
|---|---|---|---|
| 636,140 | 4/1950 | United Kingdom | 96/110 |

OTHER PUBLICATIONS

Cotton, et al., Advanced Inorganic Chemistry, 2nd Edition, Interscience Publishers, N. Y., 1969, pp. 550–552.

*Primary Examiner*—Won H. Louie, Jr.
*Attorney, Agent, or Firm*—A. W. Breiner

[57] ABSTRACT

A method is described of increasing the stability of direct-positive silver halide emulsions comprising reduction- and gold-fogged silver halide grains by the step of adding to the emulsion subsequent to the fogging, a sulphite and a gold compound.

18 Claims, No Drawings

DIRECT-POSITIVE SILVER HALIDE EMULSIONS

The present invention relates to direct-positive silver halide emulsions comprising reduction and gold fogged silver halide grains and to methods for the preparation of these emulsions.

It is known that direct-positive images can be obtained with certain types of photographic silver halide emulsions without previously forming a negative silver image. For example, the silver halide grains can be fogged during or after coating on a support by an overall exposure to actinic radiation or by overall chemically fogging e.g. by means of reducing agents. Upon image-wise exposure of the prefogged emulsions the development centres formed by said fogging are destroyed at the exposed areas and remain at the unexposed areas. By development of the emulsion after image-wise exposure a direct-positive image is formed.

Particularly suitable direct-positive silver halide emulsions are emulsions comprising fogged silver halide grains and electron-traps. The emulsions may comprise interior electron-traps or exterior electron traps.

Fogged direct-positive silver halide emulsions with interior electron traps are emulsions comprising silver halide grains having in their interior centres promoting the deposition of photolytic silver and an outer region of fogged silver halide. Fogged direct-positive silver halide emulsions with exterior electron-traps are emulsions having adsorbed to the surface of the fogged silver halide grains a compound accepting electrons e.g. electron-accepting dyes which may provide spectral sensitization or not.

Fogging of the silver halide grains preferably occurs by reduction and gold fogging. By combining the use of a gold compound with reduction sensitization to fog it is possible to increase speed and maximum density. However, in fogged direct positive elements the obtainable maximum density decreases during storing, owing to a loss in activity of the development centres formed by fogging e.g. by aerial oxidation.

It has now been found that the stability of a fogged direct-positive silver halide emulsion, more particularly reduction and gold fogged silver halide emulsions, against decrease in maximum density or "fading" upon storing can be markedly improved by addition of a sulphite as well as a gold compound to the fogged emulsion.

The present invention therefore provides a method of preparing a direct-positive silver halide emulsion which comprises the steps of reduction and gold fogging of the silver halide grains and subsequently adding a sulphite and a gold compound to the thus fogged silver halide emulsion.

The present invention also provides a direct-positive photographic element comprising a support and at least one silver halide emulsion layer with reduction and gold-fogged silver halide grains wherein a sulphite and a gold compound have been added to the said fogged silver halide emulsion.

In accordance with the present invention the sulphite and gold compound are added to the silver halide emulsion after fogging e.g. at the stage of addition of the coating finals e.g. electron-acceptors, spectral sensitizers, coating aids, plasticizers, hardening agents, etc. Preferred sulphites are ammonium sulphite and the alkali metal sulphites, especially sodium sulphite. The amount of sulphite may vary within wide limits and is preferably comprised between about 0.1 g and about 10 g preferably between about 0.5 g and about 5 g, per mole of silver halide.

The gold compound added to the fogged emulsion is in addition to any gold compound used for fogging. The gold compound may be the same as or differ from that used in the fogging stage. Specific examples of suitable gold compounds are potassium tetrachloroaurate, auric trichloride, potassium aurithiocyanate, etc. The amount of gold compound may also vary within very wide limits. It is preferably used in amounts comprised between about 0.001 mmole and about 1 mmole, preferably between about 0.01 mmole and about 0.1 mmole per mole of silver halide.

The direct-positive silver halide emulsions according to the present invention are fogged by reduction and treatment with a gold compound.

Reduction fogging of the silver halide grains may occur by high pH and/or low pAg silver halide precipitation or digestion conditions e.g. as described by Wood, J.Phot.Sci. 1 (1953), 163 or by treatment with reducing agents e.g. tin(II) salts which include tin(II)-chloride, tin complexes and tin chelates of the (poly)amino(poly)carboxylic acid type as described in British Pat. No. 1,209,050 filed Dec. 27, 1967 by Agfa-Gevaert N.V., formaldehyde, hydrazine, hydroxylamine, sulphur compounds such as thiourea dioxide, phosphonium salts such as tetra(hydroxymethyl)-phosphonium chloride, polyamines such as diethylenetriamine, bis(p-aminoethyl)sulphide and its water-soluble salts, etc.; preferred reducing agents are thiourea dioxide and tin(II)chloride. In addition to the reduction fogging, the silver halide grains are gold-fogged by digestion with a gold compound.

Gold fogging may occur by means of any gold compound known for use in fogging photographic silver halide grains. Specific examples of gold fogging agents are potassium tetrachloroaurate, auric trichloride, potassium aurithiocyanate, etc. It is also possible to employ a mixture of a water-soluble gold compound e.g. auric trichloride and thiocyanates forming complexes with gold and having a solvent action on the silver halide grains e.g. alkali metal and ammonium thiocyanates.

When fogging of the silver halide grains occurs by means of a reducing agent e.g. thiourea dioxide and a compound of a metal more electropositive than silver especially a gold compound, the reducing agent is preferably used initially and the gold compound subsequently. However, the reverse order can be used or both compounds can be used simultaneously.

The degree of fogging of the direct-positive emulsions used according to the invention may vary within a wide range. This degree of fogging depends, as is known in the art, on the concentration of the fogging agents used as well as on the pH, the pAg, the temperature and the duration of the fogging treatment. High photographic sensitivities are obtained at low degrees of fogging (see e.g. U.S. Pat. No. 3,501,307 and United Kingdom Patent Application No. 7742/72).

According to a preferred embodiment of the present invention, the direct-positive emulsions are of the type comprising exterior electron-traps by adsorption to the surface of the silver halide grains of one or more electron-accepting or desensitizing compounds as described e.g. in the United Kingdom patent specification 723,019.

According to Sheppard et al J.Phys.Chem. 50 (1946) 210, Stanienda, Z.Phys.Chem. (NF) 32 (1962) 238, and Dahne, Wiss. Phot. (1969) 161, desensitizers are dyestuffs whose cathodic polarographic half-wave potential, measured against the calomel electrode, is more positive than −1.0 V.

It is now well known to characterize these electron-accepting or desensitizing compounds by means of their polarographic half-wave potential. Electron acceptors suitable for use in the direct-positive silver halide emulsions of the present invention have an anodic polarographic half-wave potential and a cathodic polarographic half-wave potential that when added together give a positive sum. Methods of determining these polarographic half-wave potentials have been described, e.g., in the United States Pat. Nos. 3,501,310 of Bernard D. Illingsworth issued Mar. 17, 1970 and 3,531,290 of Roberta A. Litzerman issued Sept. 29, 1970.

The electron-accepting compounds preferably have spectrally sensitizing properties although it is possible to use electron-accepting compounds that do not spectrally sensitize the emulsion as well as spectrally sensitizing and non-spectrally sensitizing electron acceptors.

Spectrally sensitizing electron-acceptors in contrast to non-spectrally sensitizing electron-acceptors provide spectral sensitization beyond the inherent sensitivity region of the silver halide, e.g. in the case of silver bromide and silver bromoiodide emulsions in the range of the visible spectrum above about 480 nm.

For the formation of direct-positive photographic elements of reduced contrast and extended exposure latitude which are particularly suitable for the production of continuous-tone images e.g. for duplicating radiographs, it is possible to coat a support with at least two direct-positive silver halide emulsion layers each containing fogged silver halide grains, wherein the undermost emulsion layer of the said two direct-positive silver halide emulsion layers comprises one or more electron-accepting compounds, the said electron-acceptor(s) being non-spectrally sensitizing and the uppermost emulsion layer of the said two direct-positive silver halide emulsion layers comprises one or more electron-acceptors at least one of which is a spectrally sensitizing electron-acceptor. Such direct-positive photographic elements have been described in British Patent Application No. 3903/73.

Especially useful classes of electron-accepting, spectrally-sensitizing compounds are imidazoquinoxaline cyanine dyes, e.g. those described in Belgian Pat. No. 660,253 filed Feb. 25, 1965 by Kodak Co., such as 1,1',3,3'-tetraethylimidazo[4,5-b]quinoxalino-carbocyanine chloride, and cyanine dyes containing an indole nucleus with carbocyclic aromatic ring in the 2-position e.g. those described in United Kingdom Pat. No. 970,601 filed Apr. 9, 1963 by Agfa AG and in United States Pat. Nos. 2,930,694 of Russell Pearce Heuer, issued Mar. 29, 1960 and 3,501,312 of John D. Mee and Donald W. Heseltine, issued Mar. 17, 1970, such as 1,1-dimethyl-2,2'-diphenyl-3,3'-indolocarbocyanine bromide, 1,1'-dimethyl-2,2'-di-p-methoxyphenyl-3,3'-indolocarbocyanine bromide and 1,1'-dimethyl-2,2',8-triphenyl-3,3'-indolocarbocyanine perchlorate and U.S. Pat. No. 3,615,610 of Raymond Leopold Florens, Johannes Gotze, August Randolph and Theofiel Hubert Ghys.

Especially useful spectrally sensitizing electron-acceptors are described in the latter United States Patent; they can be represented by the formula:

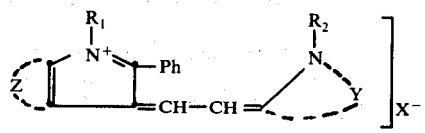

wherein:

each of $R_1$ and $R_2$ represents alkyl including substituted alkyl of the type generally known in cyanine dye chemistry such as methyl, ethyl, n-propyl, n-butyl, n-amyl, isopropyl, isobutyl, β-hydroxyethyl, β-acetoxyethyl, sulfoethyl, sulfopropyl, sulfobutyl, sulfatopropyl or sulfatobutyl, an unsaturated aliphatic group e.g. allyl, an aralkyl group e.g. benzyl, a substituted benzyl group such as carboxybenzyl, an aryl group e.g. phenyl, a substituted aryl group such as carboxyphenyl, a cycloalkyl group such as cyclohexyl and cyclopentyl or a substituted alkyl group such as the group —A—CO—O—B—$SO_2OH$ wherein each of A and B represents a hydrocarbon group as described in the United Kingdom Pat. No. 886,271, filed June 20, 1957 by Gevaert Photo-Producten N.V., or the group —A—W—N-H—V—B, wherein A represents a methylene group, an ethylene group, a propylene group or a butylene group, B represents an alkyl group, an amino group, a substituted amino group and also a hydrogen atom if V is a single bond, and each of W and V represents a carbonyl group, a sulfonyl group or a single bond, but at least one of them representing a sulfonyl group, as described in the United Kingdom Pat. No. 904,332 filed July 5, 1957, by Gevaert Photo-Producten N.V., Ph represents a phenyl group including substituted phenyl e.g. an alkyl-, aryl-, alkoxy- or halogen substituted phenyl group, said substituents preferably standing in the p-position, Z represents the necessary atoms to form a fused-on benzene nucleus, which may be substituted e.g. by halogen, an alkyl, or an alkoxy group, $X^-$ represents an anion e.g. $Cl^-$, $Br^-$, $I^-$, $ClO_4^-$, $CH_3SO_4^-$ and

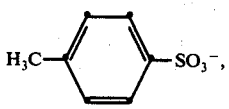

but $X^-$ is not present if $R_1$ itself contains an anionic group, and

Y represents the necessary atoms to complete a heterocyclic nucleus of the types used in the production of cyanine dyes e.g. such as those of the thiazole series e.g. thiazole, 4-methylthiazole, 4-methyl-5-carbethoxythiazole, 4-phenylthiazole, 5-methylthiazole, 5-phenylthiazole, 4-(p-tolyl)-thiazole, 4-(p-bromophenyl)-thiazole, 4,5-dimethylthiazole, 4,5-diphenylthiazole, 4-(2-thienyl)-thiazole, 4-(m-nitrophenyl)-thiazole, those of the benzothiazole series e.g. benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 6-sulphobenzothiazole, 4-phenylbenzothiazole, 5-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, 4,5,6,7-tetrahydrobenzothiazole, 5,6-dimethoxybenzothiazole, 5,6-dioxymethylenebenzothiazole, 5-hydroxybenzothiazole, 6-hydroxybenzothiazole, 5,6-dimethylbenzothiazole, those of the naphthothiazole series e.g. naphtho[2,1-d]thiazole, naphtho[1,2-d]thiazole, 5-methoxynaphtho[1,2-d]thiazole, 5-ethoxynaphtho[1,2-d]thiazole, 8-methoxynaphtho[2,1-d] thiazole, 7-methoxynaphtho[2,1-d]thiazole, those of the thionaphtheno[7,6-d]thiazole series e.g. 7-methoxythionaphtheno[7,6-d]thiazole, those of the thiadiazole series e.g. 4-phenylthiadiazole, those of the oxazole series e.g. 4-methyloxazole, 5-methyloxazole, 4-phenyloxazole, 4,5-diphenyloxazole, 4-ethyloxazole, 4,5-dimethyloxazole, 5-phenyloxazole, those of the benzoxazole series e.g. benzoxazole, 5-chlorobenzoxazole, 5-methylbenzoxazole, 5-phenylbenzoxazole, 6-methylbenzoxazole, 5,6-dimethylbenzoxazole, 4,6-dimethylbenzoxazole, 5-methoxybenzoxazole, 6-methoxybenzoxazole, 5-hydroxybenzoxazole, 6-hydroxybenzoxazole, those of the naphthoxazole series, e.g. naphtho[2,1-d]oxazole, naphtho[1,2-d]oxazole, those of the selenazole series e.g. 4-methyl-selenazole, 4-phenylselenazole, those of the benzoselenazole series e.g. benzoselenazole, 5-chlorobenzoselenazole, 5-methoxybenzoselenazole, 5-hydroxybenzoselenazole, 4,5,6,7-tetrahydrobenzoselenazole, those of the naphthoselenazole series e.g. naphtho[2,1-d] selenazole, naphtho[1,2-d]selenazole, those of the 2-quinoline series e.g. quinoline, 3-methylquinoline, 5-methylquinoline, 7-methylquinoline, 8-methylquinoline, 6-chloroquinoline, 8-chloroquinoline, 6-methoxyquinoline, 6-ethoxyquinoline, 6-hydroxyquinoline, 8-hydroxyquinoline, etc., those of the pyrimidine series, those of the quinoxaline series, those of the quinazoline series, those of the 1-phthalazine series, those of the 2-pyridine series e.g. pyridine, 5-methylpyridine, 3-nitropyridine, those of the benzimidazole series e.g. benzimidazole, 5,6-dichlorobenzimidazole, 5-chlorobenzimidazole, 5,6-dibromobenzimidazole, 5-chloro-6-amino-benzimidazole, 5-chloro-6-bromobenzimidazole, 5-phenylbenzimidazole, 5-fluorobenzimidazole, 5,6-difluorobenzimidazole, 5-cyanobenzimidazole, 5,6-dicyanobenzimidazole, 5-chloro-6-cyanobenzimidazole, 5-fluoro-6-cyanobenzimidazole, 5-acetylbenzimidazole, 5-chloro-6-fluorobenzimidazole, 5-carboxy-benzimidazole, 7-carboxybenzimidazole, 5-carbethoxybenzimidazole, 7-carbethoxybenzimidazole, 5-sulphamylbenzimidazole, or 5-N-ethylsulphamylbenzimidazole.

Examples of dyes corresponding to the said general formula are listed in the following table 1.

Table 1

1.

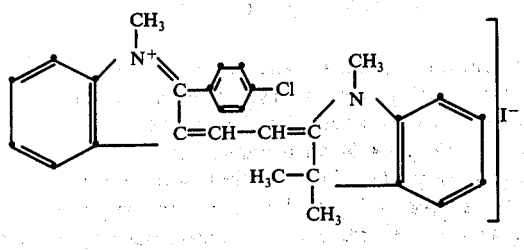

Table 1-continued

2.

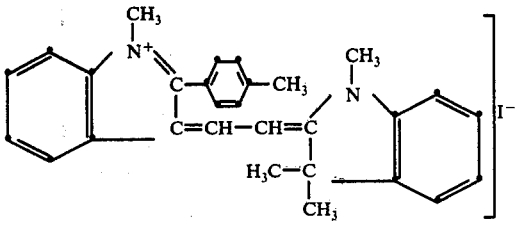

3.

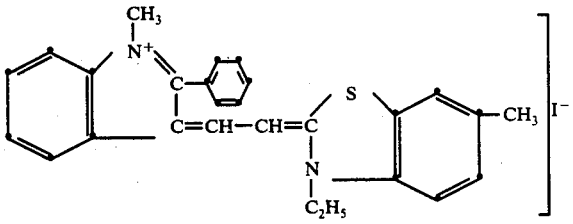

4.

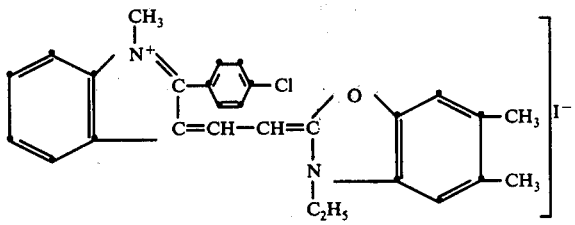

5.

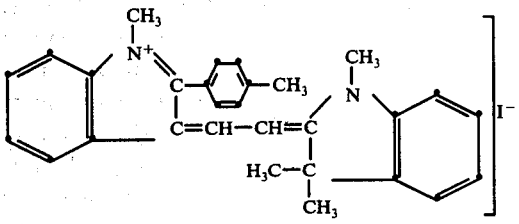

6.

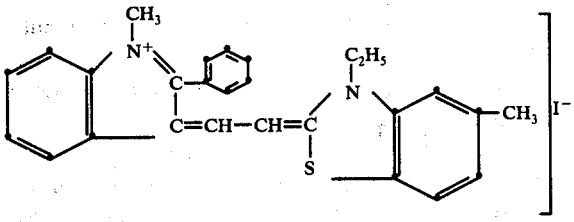

7.

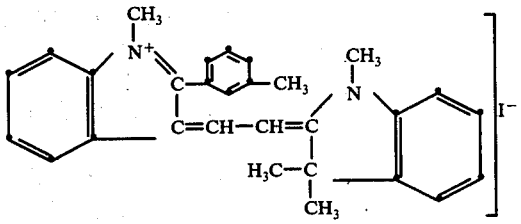

Table 1-continued

8.

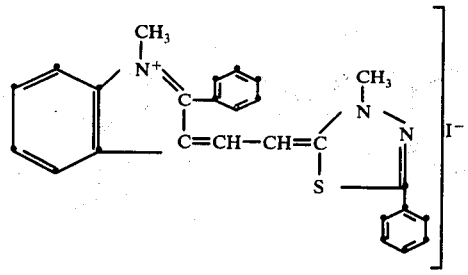

9.

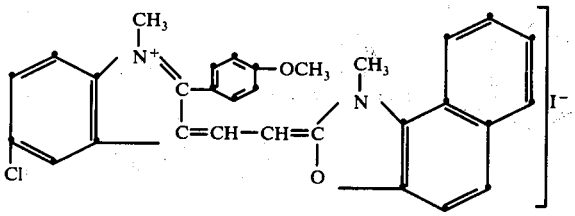

10.

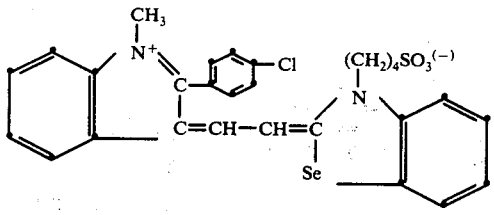

Examples of other spectrally sensitizing electron-acceptors can be found in U.S. Pat. No. 3,501,307 of Bernard D. Illingsworth, issued Mar. 17, 1970, e.g. cyanine and merocyanine dyes in which at least one nucleus and preferably two nuclei contain desensitizing substituents such as nitro e.g. 3,3'-diethyl-6,6'-dinitrothiocarbocyanine chloride, 1',3-diethyl-6-nitrothia-2'-cyanine iodide, 3,3'-diethyl-6,6'-dinitro-9-phenylthiacarbocyanine iodide, 3,3'-di-p-nitrophenylthiacarbocyanine iodide, 3,3'-dimethyl-9-trifluoromethylthiacarbocyanine iodide, 9-(2,4-dinitrophenylmercapto)-3,3'-diethylthiocarbocyanine iodide, etc.

The pyrimidone and thiopyrimidone dyes of published German Patent Application No. 2057617 filed Nov. 24, 1970 by Agfa-Gevaert AG, are also suitable spectrally sensitizing electron-acceptors.

Especially useful non-spectrally sensitizing electron-acceptors for the direct-positive silver halide emulsion layers of the photographic element according to the present invention are nitrostyryl and nitrobenzylidene dyes representatives of which can be found in United Kingdom Pat. Nos. 667,206 filed June 28, 1949 by Kodak Co., 698,275 filed Jan. 12, 1951 by Schering AG, 698,576 filed Aug. 1, 1951 by Ilford and 834,839 filed Aug. 27, 1957 by Ilford and in U.S. Pat. No. 2,953,561 of Norman J. Doorenbos, issued Sept. 20, 1960.

They can be represented as described in U.S. Pat. No. 3,615,610 mentioned above, by the following general formulae:

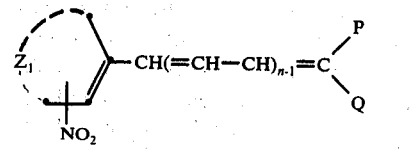

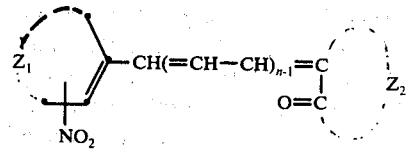

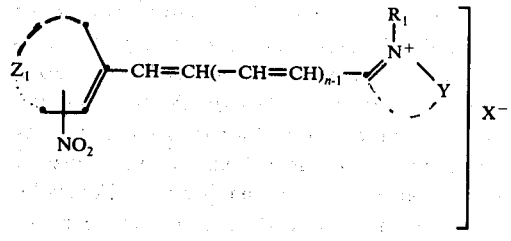

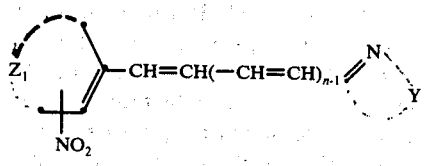

wherein one or more of the methine groups may be substituted e.g. with a cyano group, $R_1$, $X^-$ and Y have the same significance as described above, $Z_1$ represents the necessary atoms to close an aromatic nucleus e.g. a benzene nucleus, which may be further substituted e.g. with another nitro group, each of P and Q represents an organic group with electro-negative character e.g.

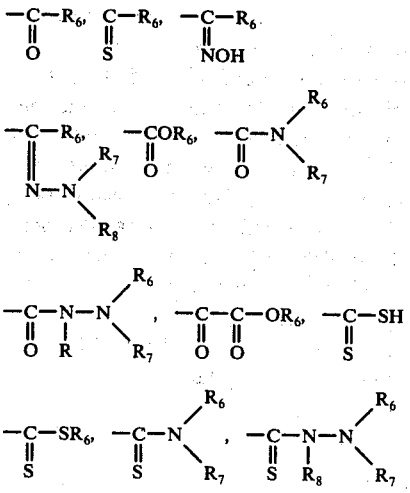

(wherein each of $R_6$, $R_7$, and $R_8$ represents a hydrogen atom, an alkyl group, an aryl group, an aralkyl group, or a heterocyclic group, which groups may be substituted), $—NO_2$, —CN, an aromatic homocyclic monovalent group e.g. phenyl or naphthyl, which group may be substituted preferably with an electronegative group as hereinbefore described or a monovalent heterocyclic group with aromatic character e.g. a furyl, thienyl, pyrrolyl, indolyl, or

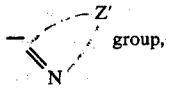

group, wherein Z' represents the necessary atoms to close a heterocyclic nucleus with aromatic character, which groups may be substituted, $Z_2$ represents the necessary atoms to close a cyclic ketomethylene nucleus such as one of those of the pyrazolone series e.g., 3-methyl-1-phenyl-5-pyrazolone, 1-phenyl-5-pyrazolone, 1-(2-benzothiazolyl)-3-methyl-5-pyrazolone, those of the isoxazolone series e.g., 3-phenyl-5-isoxazolone, or 3-methyl-5-isoxazolone, those of the oxindole series e.g. 1-alkyl-2,3-dihydro-2-oxindoles, those of the 2,4,6-triketohexahydropyrimidine series e.g. barbituric acid or 2-thiobarbituric acid as well as their derivatives such as those substituted in the 1-position by an alkyl group such as methyl group, an ethyl group, an 1-n-propyl group, and a 1-n-heptyl group, or those substituted in the 1- and 3-position by an alkyl group, or those substituted in the 1- or 3-position by a β-methoxy-ethyl group, or those substituted in the 1- and 3-position by an aryl group such as phenyl group, or those substituted in the 1- and 3-position by a substituted phenyl group such as a p-chlorophenyl group, or a p-ethoxycarbonylphenyl group, or those substituted only in the 1-position by a phenyl-, p-chlorophenyl-, or p-ethoxycarbonylphenyl group, further the mixed alkyl-aryl-substituted derivatives such as 1-ethyl-3-phenyl, and 1-n-heptyl-3-phenyl derivatives, those of the rhodanine series i.e., 2-thio-2,4-thiazolidine-dione series, e.g. rhodanine, and aliphatically substituted rhodanines e.g., 3-ethyl-rhodanine, or 3-allylrhodanine, those of the imidazo[1,2-a]pyridone series, those of the 5,7-dioxo-6,7-dihydro-5-thiazole [3,2-a]pyrimidine series e.g. 5,7-dioxo-3-phenyl-6,7-dihydro-5-thiazolo[3,2-a]pyrimidine, those of the 2-thio-2,4-oxazolidinedione series i.e. those of the 2-thio-2,4-oxazoledione series e.g. 3-ethyl-2-thio-2,4-oxoazolidinedione, those of the thianaphthenone series e.g. 3-thianaphthenone, those of the 2-thio-2,5-thiazolidinedione series i.e. the 2-thio-2,5-thiazoledione series e.g. 3-ethyl-2-thio-2,5-thiazolidinedione, those of the 2,4-thiazolidinedione series e.g. 2,4-thiazolidinedione, 3-ethyl-2,4-thiazolidinedione, 3-phenyl-2,4-thiazolidinedione, 3-α-naphthyl-2,4-thiazolidinedione, those of the thiazolidone series e.g. 4-thiazolidone, 3-ethyl-4-thiazolidone, 3-phenyl-4-thiazolidone, 3-α-naphthyl-4-thiazolidone, those of the 4-thiazolone series e.g. 2-ethylmercapto-4-thiazolone, 2-alkylphenylamino-4-thiazolones, 2-diphenylamino-4-thiazolone, those of the 2-imino-2,4-oxazolinone i.e. pseudohydantoin series, those of the 2,4-imidazolinedione (hydantoin) series e.g. 2,4-imidazolinedione, 3-ethyl-2,4-imidazolinedione, 3-phenyl-2,4-imidazolinedione, 3-α-naphthyl-2,4-imidazolinedione, 1,3-diethyl-2,4-imidazolinedione, 1-ethyl-3-phenyl-2,4-imidazolinedione, 1-ethyl-3-α-naphthyl-2,4-imidazolinedione, 1,3-diphenyl-2,4-imidazolinedione, those of the 2-thio-2,4-imidazolinedione (i.e. 2-thiohydantoin) series, e.g., 2-thio-2,4-imidazolinedione, 3-ethyl-2-thio-2,4-imidazolinedione, 3-phenyl-2-thio-2,4-imidazolinedione, 3-α-naphthyl-2-thio-2,4-imidazolinedione, 1,3-diethyl-2-thio-2,4-imidazolinedione, 1-ethyl-3-phenyl-2-thio-2,4-imidazolinedione, 1-ethyl-3-α-naphthyl-2-thio-2,4-imidazolinedione, 1,3-diphenyl-2-thio-2,4-imidazolinedione, those of the 5-imidazolone series e.g. 2-n-propylmercapto-5-imidazolone, and those of the homocyclic ring systems represented by the following structural formulae:

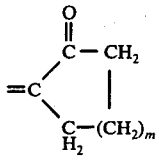
wherein m represents 1, 2, or 3,

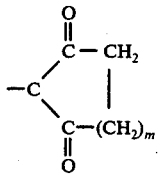
wherein m represents 1, 2, or 3,

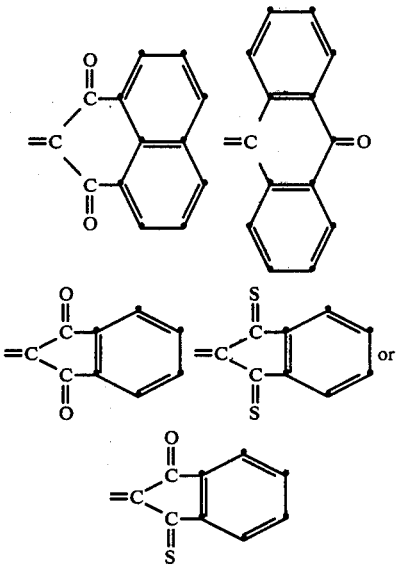

*n* represents a positive integer 1 or 2.

Particularly suitable desensitizing methine dyes according to said general formulae are listed in the following table 2.

Table 2

I.

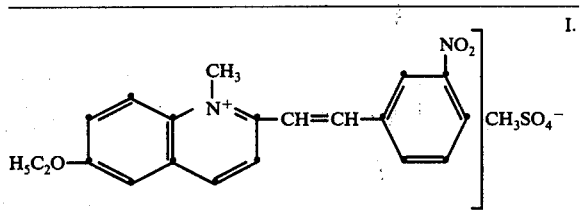

II.

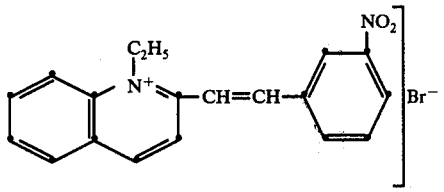

III.

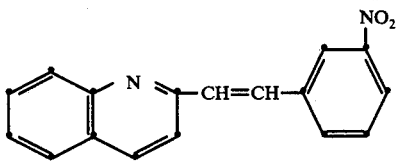

Table 2-continued

IV.

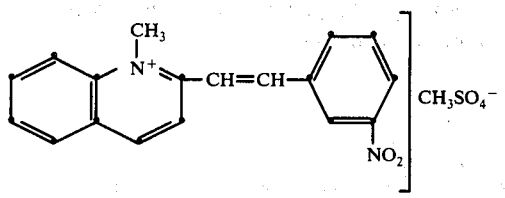

V.

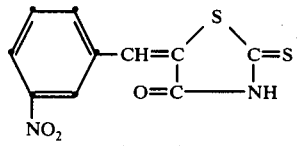

Other examples of non-spectrally sensitizing electronacceptors include 2,3,5-triphenyl-2H-tetrazolium chloride, 2-(4-iodo-phenyl)-3-(4-nitrophenyl)-5-phenyl tetrazolium chloride, 1-methyl-8-nitroquinolinium methyl sulphate, 1-m-nitrobenzyl-quinolinium chloride, 1-m-nitrobenzylpyridinium chloride, 1-p-nitrobenzylisoquinolinium chloride, 1-p-nitrobenzylbenzo]f]-quinolinium chloride, 1-methyl-2-m-nitrostyryl-quinolinium methyl sulphate, and the dihydropyrimidine compounds of United Kingdom Pat. No. 796,873, filed Dec. 10, 1954 by Gevaert Photo-Producten N.V.

The spectrally sensitizing as well as the non-spectrally sensitizing electron-acceptors are preferably incorporated in the washed, finished silver halide emulsions and should be uniformly distributed throughout the emulsions. They can be incorporated according to methods well known to those skilled in the art of emulsion making e.g. from solutions in appropriate solvents such as water, methanol, ethanol, pyridine, etc. or mixtures of solvents.

The electron acceptors can be used in widely varying concentrations. The total amount of electron acceptor(s) is preferably comprised between about 50 mg and about 2000 mg, preferably between about 100 mg and 1000 mg per mole of silver halide.

Various silver salts may be used as the light-sensitive salt e.g. silver chloride, silver chloroiodide, silver bromide, silver bromoiodide, silver bromochloride and silver bromochloroiodide but it is preferred to use silver halides predominantly consisting of silver bromide e.g. silver bromide emulsions which may have a silver iodide content of at most 8 mole %.

In the preparation of the direct-positive photographic silver halide emulsion for use in accordance with the present invention gelatin is preferably used as vehicle for the silver halide grains. However, the gelatin may be wholly or partly replaced by other natural hydrophilic colloids, e.g. albumin, zein, agar-agar, gum arabic, alginic acid, and derivatives thereof e.g. salts, amides and esters, starch and derivatives thereof, cellulose derivatives e.g. cellulose ethers, partially hydrolyzed cellulose acetate, carboxymethyl cellulose, etc. or synthetic hydrophilic resins, for example polyvinyl alcohol, polyvinyl pyrrolidone, homo- and copolymers of acrylic and methacrylic acid or derivatives e.g. esters, amides and nitriles, vinyl polymers e.g. vinyl ethers and vinyl esters.

The direct-positive silver halide emulsions for use in accordance with the present invention may comprise additional additives known to be beneficial in photographic emulsions. They may comprise e.g. speed-increasing compounds, stabilizers, antistatic agents, coating aids, optical brightening agents, light-absorbing dyes, plasticizers and the like.

Spectrally sensitizing dyes that are not electronaccepting such as e.g. cyanines, merocyanines, complex (trinuclear) cyanines, complex (trinuclear) merocyanines, styryls, and hemicyanines may also be present in the emulsion.

The silver halide emulsion layer and other hydrophilic colloid layers of a direct-positive photographic material employed in accordance with the present invention may be hardened by means of organic or inorganic hardeners commonly employed in photographic silver halide elements, e.g. the aldehydes and blocked aldehydes such as formaldehyde, dialdehydes, hydroxyaldehydes, mucochloric and mucobromic acid, acrolein, glyoxal, sulphonyl halides and vinyl sulphones, etc.

The direct-positive silver halide emulsions can be coated on the support at reduced pH value, preferably a pH of about 5, and/or at increased pAg value, preferably a pAg value which corresponds to an EMF of +30 mV or less (silver against saturated calomel electrode) as described in British patent application 32889/72.

Development of the exposed direct-positive silver halide emulsions of the invention may occur in alkaline solutions containing conventional developing agents such as hydroquinones, catechols, aminophenols, 3-pyrazolidinones, phenylenediamines, ascorbic acid and derivatives, hydroxylamines, etc. or combinations of developing agents.

Development may occur by means of a combination of developing agents that have a superadditive action, e.g. hydroquinone together with N-methyl-p-aminophenol sulphate or other p-aminophenol derivatives and hydroquinone or a p-phenylenediamine colour developing agent together with 1-phenyl-3-pyrazolidinone or other 3-pyrazolidinone derivatives.

The direct-positive silver halide emulsions can be coated on one or both sides of a wide variety of supports, which include opaque supports e.g. paper and metal supports as well as transparent supports e.g. glass, cellulose nitrate film, cellulose ester film, polyvinyl acetal film, polystyrene film, polyethylene terephthalate film, polycarbonate film and other films of resinous materials. It is also possible to use paper coated with α-olefin polymers e.g. paper coated with polyethylene, polypropylene, ethylenebutene copolymers etc.

The following example illustrates the present invention.

EXAMPLE

A direct-positive silver bromoiodide (2 mole % iodide) emulsion comprising 140 g of silver halide per kg and having a ratio of gelatin to silver halide expressed as silver nitrate of 0.45 was prepared in a conventional way. Fogging occurred by high pH precipitation conditions and addition of a gold compound.

The emulsion was divided into six aliquot portions A-F. To each emulsion were added per kg: 150 mg of pinacryptol yellow and 187.5mg of the methine dye corresponding to the formula:

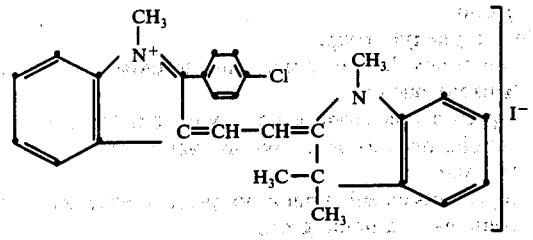

Before addition of pinacryptol yellow and methine dye the following addenda were added per kg to the individual emulsion portions:

0.02 mmol of potassium aurithiocyanate to emulsion portion B, 0.02 mmol of gold trichloride to emulsion portion C, 1 g of sodium sulphite to emulsion portion D, first 0.02 mmol of potassium aurithiocyanate and then 1 g of sodium sulphite to emulsion portion E, and first 0.02 mmol of gold trichloride and then 1 g of sodium sulphite to emulsion portion F.

After addition of the coating aids, the emulsion portions were coated on a support and dried.

Strips of the materials formed were directly exposed and processed whereas other strips were first stored for 3 days at 45° C and 70% relative humidity and then exposed and processed.

Exposure occurred through a continuous grey wedge with constant 0.15 by means of ordinary incandescent bulbs and processing occurred in an automatic 90 seconds processing machine. Development took place for 23 seconds at 35° C in Agfa-Gevaert's hardening developer for automatic processing G 138 which comprises hydroquinone and 1-phenyl-3-pyrazolidinone as developing agents and glutaraldehyde as hardener.

The sensitometric results obtained are listed in the following table. The speed, measured at density 1, is given in log It values. An increase of the value with 0.30 means a doubling of the speed.

Table

| Emulsion | g $AgNO_3$/ sq.m | Fresh materials | | | Stored materials | | |
|---|---|---|---|---|---|---|---|
| | | $D_{min}$ | speed | $D_{max}$ | $D_{min}$ | speed | $D_{max}$ |
| A | 5.92 | 0.01 | 1.28 | 175 | 0.01 | 1.35 | 121 |
| B | 5.84 | 0.01 | 1.20 | 229 | 0.01 | 1.14 | 177 |
| C | 5.65 | 0.01 | 1.16 | 222 | 0.01 | 1.11 | 182 |
| D | 5.41 | 0.01 | 1.32 | 160 | 0.01 | 1.30 | 123 |
| E | 5.57 | 0.01 | 1.23 | 230 | 0.03 | 1.13 | 212 |
| F | 5.57 | 0.02 | 1.23 | 230 | 0.04 | 1.13 | 218 |

The above results learn that emulsions E and F show better stability against reduction of $D_{max}$ upon storing than the emulsions A, B, C and D. Moreover, it appears from the results obtained with the fresh materials that the addition of gold compound to the fogged emulsion increases $D_{max}$ (emulsions B and C) and that this increase is retained when sulphite is also added (emulsions E and F).

We claim:

1. A direct-positive photographic element comprising a support and at least one silver halide emulsion layer with reduction and gold-fogged silver halide grains, characterized in that before development a sulphite selected from the group consisting of ammonium sulphite or an alkali metal sulphite and a gold compound have been added to the fogged silver halide emulsion in an amount sufficient to stabilize the $D_{max}$ of the silver image to be formed.

2. A direct-positive photographic element according to claim 1, wherein sulphite has been added to the fogged silver halide emulsion in an amount comprised between about 0.1 and about 10 g per mole of silver halide.

3. A direct-positive photographic element according to claim 1, wherein gold compound has been added to the fogged silver halide emulsion in an amount comprised between about 0.001 mmole and about 1 mmole per mole of silver halide.

4. A direct-positive photographic element according to claim 1, wherein the fogged silver halide emulsion layer comprises a spectrally sensitizing and a non-spectrally sensitizing electron acceptor.

5. A direct-positive photographic element according to claim 4, wherein the spectrally sensitizing electronacceptor is a methine dye with at least one indolo nucleus having a carbocyclic aromatic ring in the 2-position.

6. A direct-positive photographic element according to claim 5, wherein the spectrally sensitizing electronacceptor is a 2-phenyl-indole methine dye corresponding to the formula:

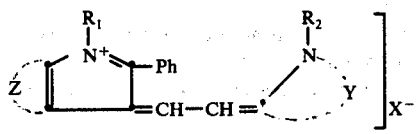

wherein:

each of $R_1$ and $R_2$ represents an alkyl group or an aryl group,

Ph is a phenyl group,

Z represents the atoms necessary to close a fused-on benzene nucleus,

Y represents the atoms necessary to complete a heterocyclic nucleus as known in cyanine dye chemistry, and X represents an anion but is not present when $R_1$ itself contains an anionic group.

7. A direct-positive photographic element according to claim 4, wherein the non-spectrally sensitizing electron-acceptor is a nitrostyryl or nitrobenzylidene compound.

8. A direct-positive photographic element according to claim 7, wherein said nitrostyryl or nitrobenzylidene compound corresponds to one of the formulae:

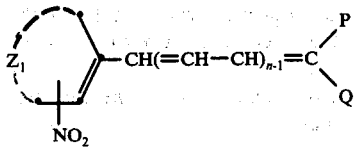

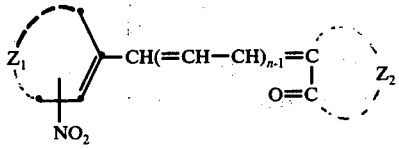

-continued

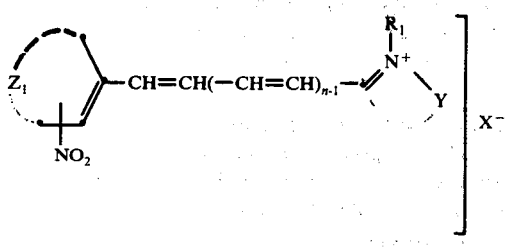

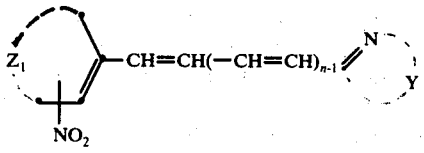

wherein:

$R_1$ is an alkyl group

Y represents the necessary atoms to complete a heterocyclic nucleus of the type used in the production of cyanine dyes, $Z_1$ represents the necessary atoms to close a benzene nucleus, each of P and Q is an organic group with electronegative character, $Z_2$ represents the atoms necessary to close a cyclic ketomethylene nucleus, $X^-$ is an anion but does not exist when $R_1$ contains an anionic group, and

*n* is 1 or 2.

9. Method of preparing a direct-positive photographic silver halide emulsion comprising the steps of reduction and gold fogging of the silver halide grains and subsequently adding before development a sulphite selected from the group consisting of ammonium sulphite and an alkali metal sulphite and a gold compound to the thus fogged silver halide emulsion in an amount sufficient to stabilize the $D_{max}$ of the silver image to be formed.

10. Method according to claim 9, wherein sulphite is added in an amount between about 0.1 g and about 10 g per mole of silver halide.

11. Method according to claim 9, wherein the gold compound is added to the fogged silver halide emulsion in an amount between about 0.001 mmole and about 1 mmole per mole of silver halide.

12. Method according to claim 9, wherein a spectrally sensitizng and a non-spectrally sensitizing electronacceptor are added, after addition of the sulphite and gold compound, to the fogged silver halide emulsion.

13. Method according to claim 12, wherein the spectrally sensitizing electronacceptor is a methine dye with at least one indolo nucleus having a carbocyclic aromatic ring in the 2-position.

14. Method according to claim 13, wherein the dye corresponds to the formula:

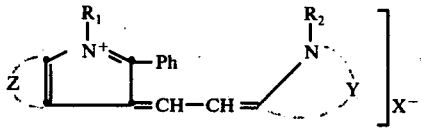

wherein:

each of $R_1$ and $R_2$ represents an alkyl group or an aryl group,

Ph is a phenyl group,

Z represents the atoms necessary to close a fused-on benzene nucleus,

Y represents the atoms necessary to complete a heterocyclic nucleus as known in cyanine dye chemistry, and X represents an anion but is not present when $R_1$ itself contains an anionic group.

15. Method according to claim 12, wherein the non-spectrally sensitizing electronacceptor is a nitrostyryl or nitrobenzylidene compound.

16. Method according to claim 15, wherein the nitrostyryl or nitrobenzylidene compound corresponds to one of the formulae:

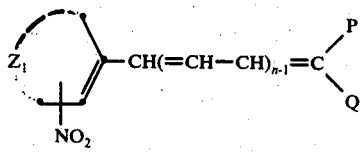

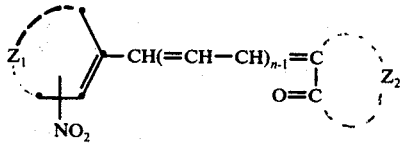

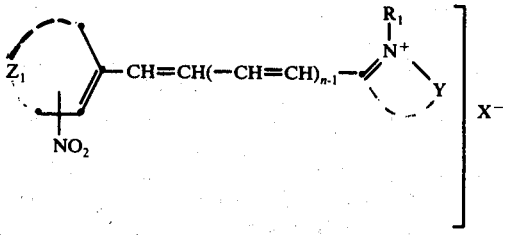

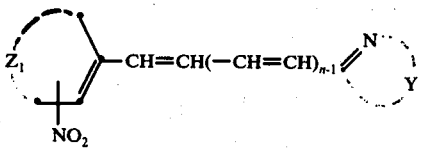

wherein:

$R_1$ is an alkyl group,

Y represents the necessary atoms to complete a heterocyclic nucleus of the type used in the production of cyanine dyes, $Z_1$ represents the necessary atoms to close a benzene nucleus, each of P and Q is an organic group with electronegative character, $Z_2$ represents the atoms necessary to close a cyclic ketomethylene nucleus, $X^-$ is an anion but does not exist when $R_1$ contains an anionic group, and

*n* is 1 or 2.

17. The direct-positive photographic element according to claim 1 wherein the said sulphite and the said gold compound are added to the silver halide emulsion during emulsion preparation.

18. The method of claim 9 wherein the said sulphite and the said gold compound are added to the silver halide emulsion during emulsion preparation.

* * * * *